US009022503B2

(12) United States Patent
Toya

(10) Patent No.: US 9,022,503 B2
(45) Date of Patent: May 5, 2015

(54) PRINTING APPARATUS

(71) Applicant: Seiko Epson Corporation, Tokyo (JP)

(72) Inventor: Akihiro Toya, Matsumoto (JP)

(73) Assignee: Seiko Epson Corporation, Tokyo (JP)

( * ) Notice: Subject to any disclaimer, the term of this patent is extended or adjusted under 35 U.S.C. 154(b) by 0 days.

(21) Appl. No.: 14/198,115

(22) Filed: Mar. 5, 2014

(65) Prior Publication Data

US 2014/0292865 A1 Oct. 2, 2014

(30) Foreign Application Priority Data

Mar. 27, 2013 (JP) ..... 2013-065799

(51) Int. Cl.
*B41J 2/07* (2006.01)
*B41J 2/21* (2006.01)

(52) U.S. Cl.
CPC ..... *B41J 2/2114* (2013.01)

(58) Field of Classification Search
CPC ..... B41J 2/07; B41J 2/0458; B41J 2/04563; B41J 29/393; B41J 2/04581; B41J 2/04591
See application file for complete search history.

(56) References Cited

U.S. PATENT DOCUMENTS 6,834,947 B2 * 12/2004 Moriyama et al. ..... 347/96
7,717,551 B2 * 5/2010 Kadomatsu et al. ..... 347/102
2009/0160897 A1 * 6/2009 Inoue ..... 347/14
2011/0285769 A1 * 11/2011 Ito ..... 347/9

FOREIGN PATENT DOCUMENTS

JP 2002-307755 10/2002

* cited by examiner

*Primary Examiner* — Manish S Shah
*Assistant Examiner* — Jeremy Delozier
(74) *Attorney, Agent, or Firm* — Workman Nydegger

(57) ABSTRACT

A printing apparatus includes a head and a control section. The head ejects an imaging liquid for forming an image and an auxiliary liquid for assisting the formation of the image by the imaging liquid with respect to a printing medium. The control section controls the head so that the imaging liquid and the auxiliary liquid are ejected with respect to the printing medium. Further, if there is a first region in which the imaging liquid and the auxiliary liquid are ejected, and a second region which is peeled after the image is formed in the first region in a region of the printing medium, the control section controls the head so that ejection of the auxiliary liquid is not executed with respect to the second region.

8 Claims, 13 Drawing Sheets

PRINTING APPARATUS

BACKGROUND

1. Technical Field

Embodiments of the present invention relate to a printing apparatus.

2. Related Art

An ink jet type printer is a printing apparatus that forms an image on a printing medium by ejecting ink from a head. Printing may be performed using color inks such as CMY and a colorless transparent ink (clear ink).

JP-A-2002-307755 is an example of related art.

A film-based medium configured of polystyrene, polypropylene or the like may be used as the printing medium. A medium surface of the film-based medium may become charged by friction or the like with a paper feeding roller made of metal (aluminum, iron or the like) inside the printer. Further, since a charging amount (or the amount of charge on the medium surface) is influenced by a state of the friction, variation of the charging amount occurs on the medium surface.

If the ink is ejected with respect to the printing medium in which the variation of the charging or of the charging amount occurs, ink mist (so-called satellites) accumulates in a region in which the charging amount is large. As a result, a haze-like image deterioration occurs on the printing medium.

On the other hand, it is possible to make the distribution of the charging amount be uniform and to reduce the influence of the satellites by applying an auxiliary ink such as the clear ink with respect to the printing medium in advance.

However, even if the distribution of the charging amount is uniform, the satellites still accumulate in the region in which a liquid such as the ink is ejected.

SUMMARY

An advantage of some aspects of embodiments of the invention is to provide a printing apparatus capable of reducing the influence of satellites with respect to a region in which a liquid is ejected or a region in which an image is formed.

A printing apparatus according to an aspect of the invention includes a head and a control section. The head ejects an imaging liquid for forming an image with respect to a printing medium and an auxiliary liquid for assisting the formation of the image by the imaging liquid. The control section controls the head so that the imaging liquid and the auxiliary liquid are ejected with respect to the printing medium. Further, if there is a first region in which the imaging liquid and the auxiliary liquid are ejected, and a second region which is peeled after the image is formed in the first region, the control section controls the head so that ejection of the auxiliary liquid is not executed with respect to the second region.

Other features of embodiments of the invention will be apparent from description of the specification and accompanying drawings.

BRIEF DESCRIPTION OF THE DRAWINGS

Embodiments of the invention will be described with reference to the accompanying drawings, wherein like numbers reference like elements.

DESCRIPTION OF EXEMPLARY EMBODIMENTS

Overview of Disclosure

Figure 1:
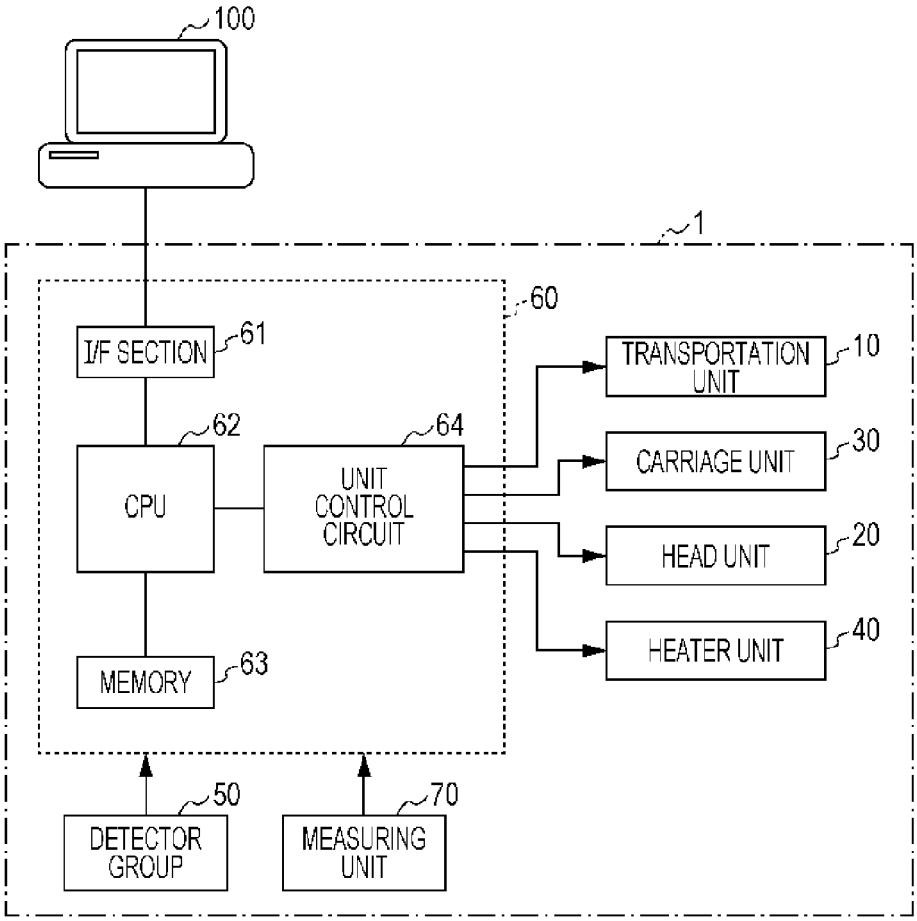
FIG. 1 is a view illustrating an example configuration of a printing apparatus.

At least the following matters will be made clear by the specification and the accompanying drawings.

A printing apparatus is provided and includes a head that ejects an imaging liquid for forming an image and an auxiliary liquid for assisting formation of the image by the imaging liquid with respect to a printing medium. The printing apparatus includes a control section that controls the head so that the imaging liquid and the auxiliary liquid are ejected with respect to the printing medium. In a region of the printing medium, if there is a first region in which the imaging liquid and the auxiliary liquid are ejected, and a second region which is peeled after the image is formed in the first region, the control section controls the head so that ejection of the auxiliary liquid is not executed with respect to the second region. In this case, it is possible to reduce the influence of satellites with respect to the region in which the liquid is ejected.

Further, in the printing apparatus, the control section may control the head so that the ejection of the auxiliary liquid may be executed with respect to a region in (or portion of) the second region that is adjacent to a boundary between the first region and the second region. In this case, it is possible to further reduce the influence of satellites with respect to the region in which the liquid is ejected and it is possible to prevent variations in the surface quality of the printed matter.

Further, in the printing apparatus, the control section may be capable of selectively executing a plurality of modes in which ejection amounts of the auxiliary liquid or the amount of auxiliary liquid ejected are different from each other. In this case, it is possible to select the ejection amount of the auxiliary liquid.

Further, the printing apparatus may further include a measuring section that measures a humidity of the printing medium. If a measured result of the measuring section is equal to a predetermined threshold or less, the control section may control the head so that an ejection amount of the auxiliary liquid is increased. In this case, it is possible to increase the ejection amount of the auxiliary liquid if the humidity is low.

Further, in the printing apparatus, the control section may control the head so that the ejection of the imaging liquid and the ejection of the auxiliary liquid are executed with respect to the first region in different passes.

Further, in the printing apparatus, the control section may control the head so that the ejection of the imaging liquid and the ejection of the auxiliary liquid are executed with respect to the first region in the same pass.

Further, in the printing apparatus, the control section may control the head so that the ejection of the auxiliary liquid is executed with respect to a region in (or a portion of) the first region, which includes the region in which the imaging liquid is ejected. Further, in the printing apparatus, the control section may control the head so that the ejection of the auxiliary liquid is executed with respect to a region in the first region in which the imaging liquid is not ejected.

According to the printing apparatus described above, it is possible to adjust ejecting timings of the imaging liquid and of the auxiliary liquid and it is possible to adjust the region in (or portion of) the first region in which the imaging liquid and the auxiliary liquid are ejected. It is also possible to adjust the region in or portion of the second region in which the auxiliary liquid and/or the imaging liquid are ejected (e.g., adjacent a cut line for example).

Configuration of Printing Apparatus

Figure 2:
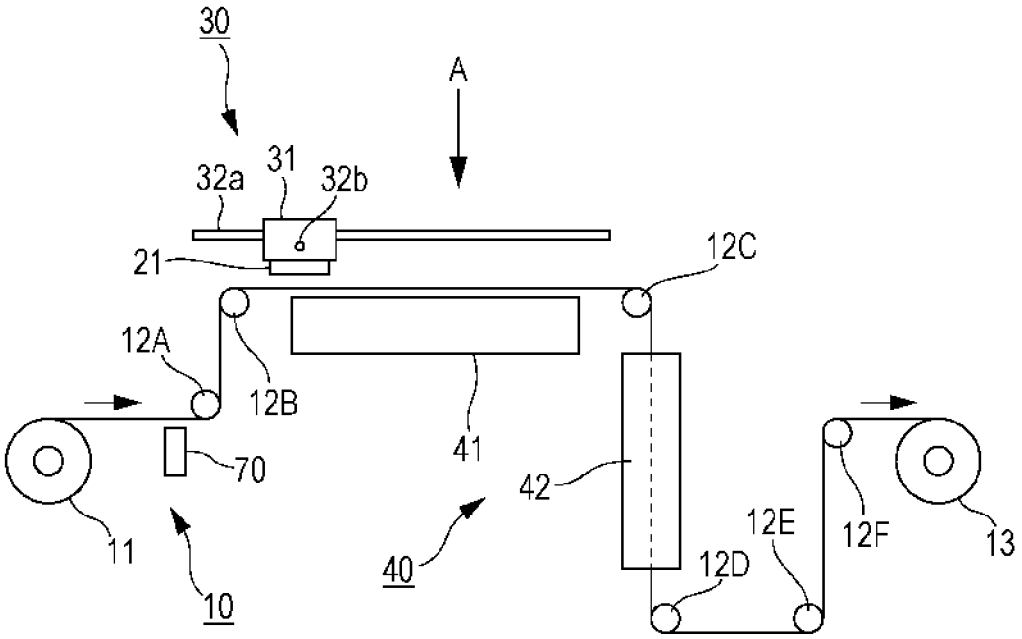
FIG. 2 is a view illustrating an example configuration of a printing apparatus.
Figure 3:
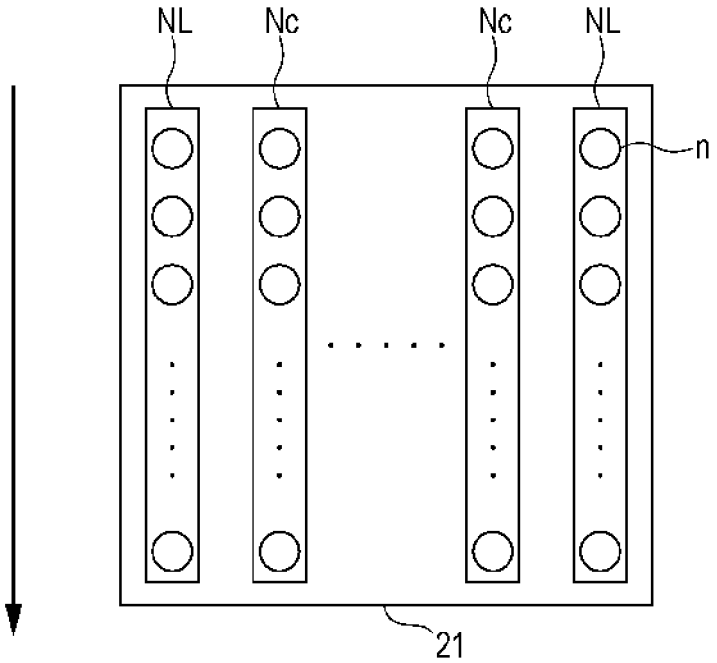
FIG. 3 is a view illustrating an example configuration of a printing apparatus.
Figure 4:
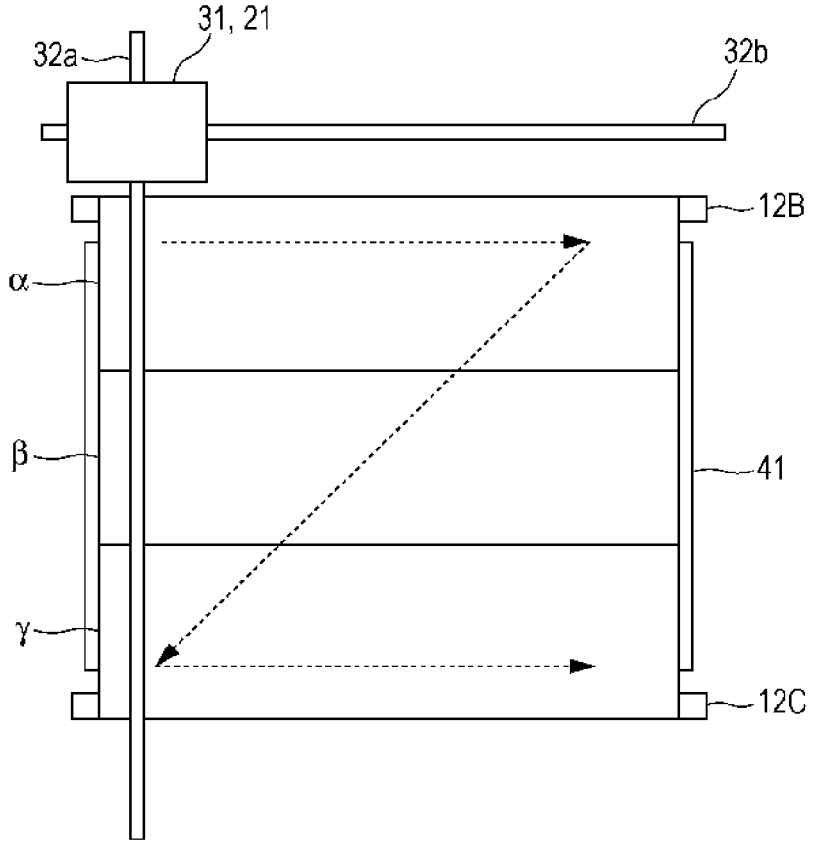
FIG. 4 is a view illustrating an example configuration of a printing apparatus.

A configuration of a printing apparatus according to an embodiment will be described with reference to FIGS. 1 to 4. An ink jet printer 1 of a lateral system (described below) is described as an example of a printing apparatus. FIG. 1 is a block diagram illustrating an example configuration of the ink jet printer 1. FIG. 2 is a schematic view illustrating a part of the configuration of the ink jet printer 1. FIG. 3 is a view illustrating an example of a head 21 (described below). FIG. 4 is a view of a printing medium viewed from a direction A in FIG. 2. In FIG. 4, a part of the configuration illustrated in FIG. 2 is omitted.

The ink jet printer 1 includes a transportation unit 10, a head unit 20, a carriage unit 30, a heater unit 40, a detector group 50, a controller 60 and a measuring unit 70. The ink jet printer 1, which receives image data for printing from a computer 100 that is an external apparatus, controls each unit (the transportation unit 10, the head unit 20, the carriage unit 30 and the heater unit 40) with the controller 60. The controller 60 controls each unit and forms (prints) an image on a printing medium, based on the image data received from the computer 100. The detector group 50 monitors situations inside the ink jet printer 1. The detector group 50 outputs a detection result to the controller 60. The controller 60 controls each unit, based on the detection result that is output from the detector group 50.

The transportation unit 10 transports a roll-shaped printing medium in a predetermined direction (hereinafter, a direction of transporting the printing medium may be referred to as "a transportation direction"). A film-based medium is described as an example of the printing medium.

As illustrated in FIG. 2, the transportation unit 10 includes a supply device 11, transportation rollers 12A to 12F, and a winding device 13. The supply device 11 delivers the printing medium to the side of the carriage unit 30 (the head unit 20). The transportation rollers 12A to 12F transport the printing medium delivered from the supply device 11 to a position (hereinafter, may be referred to as "a printing position") in which formation (printing) of the image is performed. Further, the transportation rollers 12A to 12F transport the printing medium on which the image is formed in the printing position to the winding device 13. The winding device 13 winds the printing medium on which the image is formed. Moreover, in the ink jet printer 1, the side of the supply device 11 may be referred to as "an upstream side" and the side of the winding device 13 may be referred to as "a downstream side".

The head unit 20 includes the head 21. The head 21 may eject an imaging liquid and an auxiliary liquid with respect to the printing medium.

The imaging liquid may be a liquid (color inks such as cyan, magenta, yellow are an example of the imaging liquid) for forming the image on the printing medium. The auxiliary liquid may be a liquid (clear ink and/or white ink are an example of the auxiliary liquid) for assisting the formation of the image by the imaging liquid. The auxiliary liquid may be a liquid that does not change a surface quality of the printing medium.

The image is formed on the printing medium by ejecting the imaging liquid from a nozzle n (described below) of the head 21. Further, a layer of the auxiliary liquid is formed on the printing medium by ejecting the auxiliary liquid from the nozzle n (described below) of the head 21.

FIG. 3 is a schematic view illustrating a surface of the head 21 facing the printing medium. An arrow in FIG. 3 indicates the transportation direction. As illustrated in FIG. 3, in the example of the head 21, a plurality of nozzle columns are provided in or arranged in the transportation direction. More specifically, in the head 21, a plurality of nozzle columns Nc configured to eject color inks as the imaging liquid are provided in a direction orthogonal to the transportation direction. One nozzle column ejects the same color ink. In other words, all nozzles in the same nozzle column eject the same color ink. Further, a nozzle column NL configured to eject the clear ink and/or the white ink as the auxiliary liquid is provided one column by one column so as to interleave the nozzle columns Nc therebetween. In one example, the nozzle columns Nc are placed between the nozzle columns NL. Each nozzle column includes a plurality of nozzles n. One nozzle n ejects the liquid corresponding to one dot.

The carriage unit 30 moves the head unit 20 (the head 21) in a predetermined direction. As illustrated in FIGS. 2 and 4, the carriage unit 30 includes a carriage 31, a guide 32*a* and a guide 32*b*. The carriage 31 is equipped with the head unit 20. The guide 32*a* is a member for guiding the movement of the carriage 31 in the transportation direction. The guide 32*b* is a member for guiding the movement of the carriage 31 in a direction orthogonal to the transportation direction. The carriage 31 equipped with the head unit 20 can be moved two-dimensionally by the guide 32*a* and the guide 32*b* with respect to the printing medium that is located in the printing position. Hereinafter, the direction of the movement of the carriage unit 30 (the head unit 20) may be referred to as "the moving direction". Dashed line arrows illustrated in FIG. 4 indicate motion of the carriage unit (the head unit 20) in an example. The moving direction can include movement in the transportation direction, movement in the direction orthogonal to the transportation direction, and movement in both directions at the same time.

As described above, a system that performs the formation of the image without transporting the printing medium by moving the head unit 20 two-dimensionally (or one-dimensionally) with respect to the printing medium while ejecting the liquid is referred to as "the lateral system". If the formation of the image is performed in the lateral system, when transporting the printing medium, the image based on the image data is completed on the printing medium that is in the printing position.

The heater unit 40 may include a built-in hot platen 41 and a drying device 42. The hot platen 41 may be a member configured to support the printing medium in the printing position. Further, the hot platen 41 may include a heater and may perform drying of the liquid (ink) which forms the image or the layer of the auxiliary liquid formed on the printing medium by heating the printing medium in the printing position. The drying device 42 is provided on the downstream side of the printing position and accelerates the drying of the liquid (ink) which forms the image or the layer of the auxiliary liquid outside the printing position by heating the printing medium on which the image is formed.

The detector group 50 includes a sensor that is configured to detect a transportation amount of the printing medium that is transported by the transportation unit 10, an encoder configured to detect a rotation amount of a transportation roller that transports the printing medium, a linear type encoder configured to detect a position of the carriage 31 in the transportation direction, or the like.

The controller 60 is a control unit (a control section) configured to control the ink jet printer 1. The controller 60 may include an interface (I/F) section 61, a CPU 62, a memory 63 and a unit control circuit 64.

The interface section 61 performs transmitting and receiving of data between the computer 100 and the ink jet printer 1. The CPU 62 may be an arithmetic processing unit for performing the control of the entirety of the ink jet printer 1. The memory 63 secures or includes a region for storing a program of the CPU 62 or a region for working. Further, the memory 63 stores the image data to be printed. The CPU 62 controls each unit and executes various processes through the unit control circuit 64 according to the programs stored in the memory 63.

For example, as illustrated in FIG. 4, the CPU 62 moves the head 21 two-dimensionally through the unit control circuit 64 according to the image data stored in the memory 63 (see the dashed line arrows of FIG. 4). Therefore, the ink jet printer 1 forms the image and the layer of the auxiliary liquid in the printing regions (a printing region α to a printing region γ) of the printing medium that is in the printing position, respectively (a description is given in detail below). The printing region is referred to as a region (a region in which the image and the layer of the auxiliary liquid are formed) to which the imaging liquid and the auxiliary liquid are ejected. The printing region in the embodiment is an example of "a first region".

The measuring unit 70 measures a humidity of the printing medium. The measuring unit 70 is provided or arranged, for example, in the vicinity of the printing medium in the ink jet printer 1 (see FIG. 2). The measuring unit 70 is an example of "a measuring section".

Moreover, "measuring the humidity of the printing medium" includes both directly measuring the humidity of the printing medium itself and guessing or estimating the humidity of the printing medium itself by measuring the humidity of the atmosphere around the printing medium or the like. Therefore, the measuring unit 70 may be a unit for directly measuring the humidity of the printing medium itself or may be a unit for guessing or estimating the humidity of the printing medium by measuring the humidity of the atmosphere around the printing medium.

In the latter case, a unit (the measuring unit 70) for guessing or estimating the humidity of the printing medium may be a unit for guessing or estimating the humidity of the printing medium itself. The measuring unit may estimate the humidity of the printing medium based on a humidity data table (for example, stored in the memory 63 or the like) indicating a correspondence relationship among the humidity of the atmosphere around the printing medium which is actually measured, the humidity of the atmosphere around the printing medium which is measured in advance, and the humidity of the printing medium itself. Additionally, in the atmosphere around the printing medium, especially in a transportation path of the printing medium, the measuring unit 70 may be configured so as to guess or estimate the atmosphere on the upstream side of the printing position in which the imaging liquid is ejected.

Setting of Printing Region and Peeling Region

Figure 5:
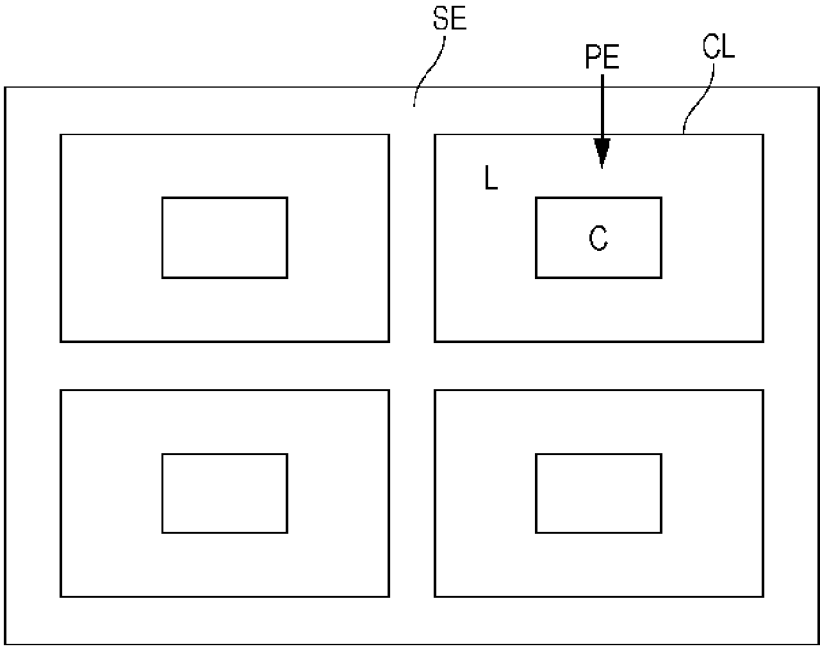
FIG. 5 is a view illustrating a printing medium on which an image is formed by a printing apparatus.

Setting of the printing region and the peeling region in the printing medium is described with reference to FIG. 5. FIG. 5 is a schematic view illustrating an example in which four images are formed with respect to the printing medium in the printing position.

In one embodiment, a printing region PE and a peeling region SE are formed with respect to the printing medium in the printing position. The peeling region SE is a region in which peeling is performed after the image is formed on the printing region PE. The peeling region SE is peeled along a boundary with the printing region PE. A line indicating the boundary is referred to as a cutline CL. The cutline CL is set in advance, based on the image data or the like. The peeling region SE in the embodiment is an example of "a second region". Both the first region and the second region may be in the printing region.

The printing region PE and the peeling region SE are set in advance before starting the printing with respect to the printing medium. For example, an operator inputs the information (for example, ID for specifying the image and the number of sheets of the image to be printed) of the image to be printed, the information (for example, the type of the printing medium and size thereof) of the printing medium which is used, and the information (for example, the position of the peeling region SE and the size thereof) of the peeling region SE to be set, through an input section of the ink jet printer 1 or the like. The controller 60 sets the printing region PE and the peeling region SE, based on the information input and the image data (e.g., the size of the image) indicating the image to be printed. Further, the controller 60 sets a region as the cutline CL in which the printing region PE comes into contact with the peeling region SE. After the printing is completed, a cutting machine (not illustrated) cuts the printing region PE along the cutline CL. Moreover, setting of the printing region PE and the peeling region SE is not limited to the example described above and may use any method.

Control of Ejecting Operation

For example, if the film-based medium is transported by the transportation unit 10, friction occurs between the transportation rollers 12A and 12B or the hot platen 41 and the film-based medium. As a result, in the film-based medium which reaches the printing position, charging occurs in the surface of the medium. In other words, the surface of the film-based medium may be charged. Because the charging amount is changed by a state of the friction, variation occurs in a charging amount of the surface of the medium. In other words, some areas of the surface of the medium may have a different charging amount.

Therefore, in order to make the charging amount in or on the surface of the medium be uniform, the auxiliary liquid is applied to the surface of the medium.

On the other hand, a distribution of satellites is also uniform when the distribution of the charging amount being uniform, and the satellites are therefore deposited in the printing region PE.

In one example, the controller 60 controls the head 21 so that the ejection of the auxiliary liquid is not executed with respect to the peeling region SE. By ejecting the auxiliary liquid in the printing region PE, it is possible to selectively accumulate the satellites in the peeling region SE. By not ejecting the auxiliary liquid in the peeling region SE, it is possible to intentionally leave a portion in which the distribution of the charging amount is not uniform. Therefore, it is possible to reduce the influence of the satellites in the printing region PE.

Moreover, the controller 60 performs the ejection of the imaging liquid and the auxiliary liquid with respect to the printing region PE which is set, based on the image data. The ejecting operation of the imaging liquid and the auxiliary liquid with respect to the printing region PE can be executed in several patterns. Description is given in detail later.

Ejecting Operation of Liquid

The ejecting operation of the liquid is described with reference to FIGS. 6A to 11C. FIGS. 6A to 11C are views schematically illustrating the printing medium in the printing position. The image (the layer of the auxiliary liquid L) on the printing medium is configured of a plurality of raster lines. The raster line is a dot column aligned in a direction orthogonal to the transportation direction of the printing medium. In the embodiment, "an nth raster line" is referred to as a raster line that is in the nth position. Moreover, in FIGS. 6A to 11C, the region corresponding to the first raster line and the nth raster line are set as the peeling region SE. Further, a "pass" is referred to as an operation for forming the dots by ejecting the liquid from the head 21 (the nozzle n) which is moved. In an example in which the imaging liquid C and the auxiliary liquid L are ejected in the same region as illustrated in FIG. 6B or the like, the dots of the imaging liquid C are indicated as smaller than that of the auxiliary liquid L to ensure overlapping of the imaging liquid C and the auxiliary liquid L. However, the dots of the imaging liquid C and the dots of the auxiliary liquid L may be the same size as each other. Alternatively, the dots of the auxiliary liquid L may be smaller than that of the imaging liquid C.

In the embodiment, four patterns may exist with respect to the ejecting operation of the imaging liquid C and the auxiliary liquid L by the head 21. On determining which pattern to use to perform the ejecting operation, for example, one pattern is set in advance for each ink jet printer 1. Otherwise, a plurality of patterns are stored in the memory 63 or the like and the operator may set any pattern for performing each printing.

First Pattern

In the first pattern, the controller 60 executes the ejection of the imaging liquid C and the ejection of the auxiliary liquid L with respect to the printing region PE in different passes. The controller 60 controls the head 21 so that the ejection of the auxiliary liquid L is executed with respect to a region in the printing region PE which includes the region in which the imaging liquid C is ejected. Further, the controller 60 does not eject the auxiliary liquid L with respect to the peeling region SE.

According to the method, the layer of the auxiliary liquid L is formed in the printing region PE and the image is formed thereon.

Figure 6A:
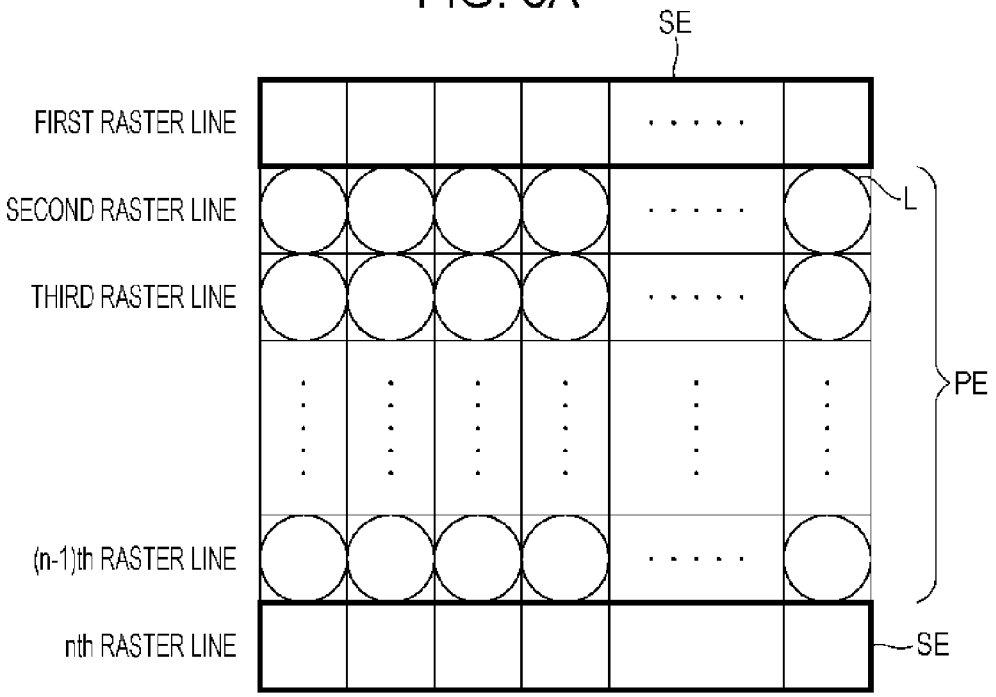
FIG. 6A is a view illustrating a first pattern of an ejecting operation of an auxiliary liquid and an imaging liquid.
Figure 6B:
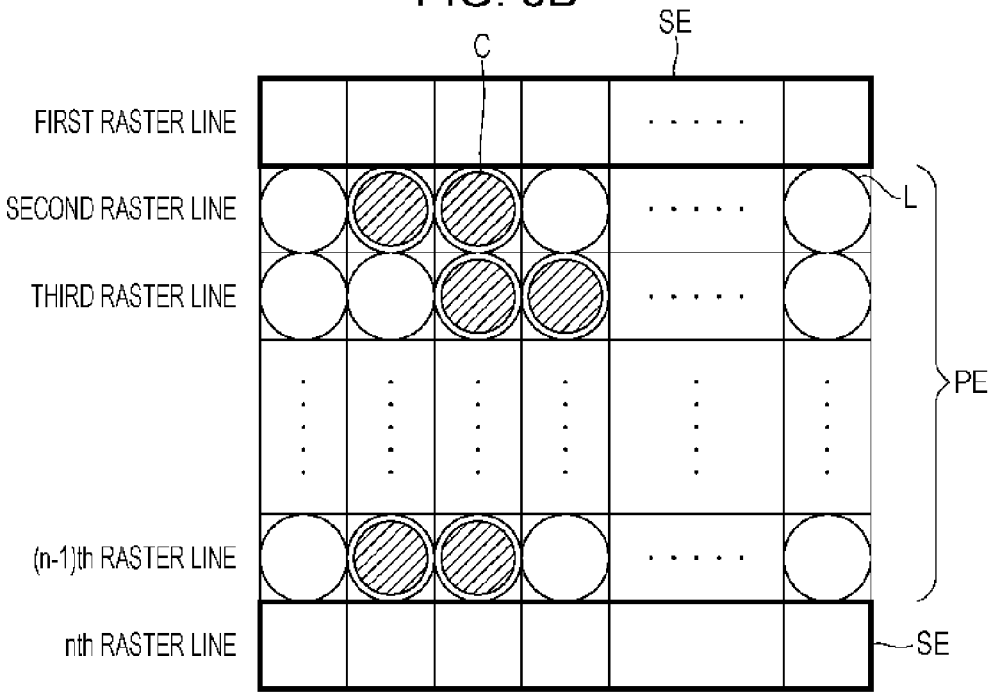
FIG. 6B is a view illustrating the first pattern of the ejecting operation of the auxiliary liquid and the imaging liquid according to the embodiment.

As a specific example, first, the head 21 moves two-dimensionally from an initial position (for example, an upper left of the printing medium illustrated in FIG. 6A) with respect to the printing medium and ejects the auxiliary liquid L with respect to the printing medium in the printing position. On the other hand, the head 21 does not eject the auxiliary liquid L in the peeling region SE (the first raster line and the nth raster line). The peeling region SE may be set in advance. In this case, the dots of the auxiliary liquid L are formed in all the raster lines (the second raster line to (n−1)th raster line) except the peeling region SE (see FIG. 6A).

Next, the head 21 moves two-dimensionally again from the initial position with respect to the printing medium and ejects the imaging liquid C with respect to the region in which the image is formed. In this case, the dots of the imaging liquid C are formed with respect to the region in which the image is formed (see FIG. 6B). Moreover, the region in which the image is formed can be determined based on the image data.

As described above, it is possible to make the charging amount of the surface of the printing medium be uniform by ejecting the auxiliary liquid L in the region of the printing medium including the region in which the image is formed to form a layer (from the auxiliary liquid) before the imaging liquid C is ejected. Therefore, it is possible to reduce the influence of the satellites on the image formed by the imaging liquid C.

Moreover, there is another method for the first pattern. For example, the head 21 ejects the auxiliary liquid L in the region corresponding to the second raster line in the first pass (see FIG. 7A). In this case, the layer of the auxiliary liquid L is formed in the second raster line. Next, the head 21 ejects the imaging liquid C with respect to the region which corresponds to the second raster line and in which the image is formed in the second pass (see FIG. 7B). Similarly, the head 21 ejects the auxiliary liquid L in the region corresponding to a (n−1)th raster line in a (n−2)th pass (see FIG. 7C) and ejects the imaging liquid C with respect to the region which corresponds to the (n−1)th raster line and in which the image is formed in a (n−1)th pass (see FIG. 7D). On the other hand, the head 21 does not eject the auxiliary liquid L in the peeling region SE (the first raster line and the nth raster line), which peeling region is set in advance.

Second Pattern

In the second pattern, the controller 60 executes the ejection of the imaging liquid C and the ejection of the auxiliary liquid L with respect to the printing region PE in different passes. In the second pattern, the controller 60 controls the head 21 so that the ejection of the auxiliary liquid L is executed with respect to a region in the printing region PE in which the imaging liquid C is not ejected. Further, the controller 60 does not eject the auxiliary liquid L with respect to the peeling region SE.

According to the method, the layer of the auxiliary liquid L is formed only with respect to the region (the region in which the image is not formed) in the printing region PE, in which the imaging liquid C is not ejected.

Figure 8A:
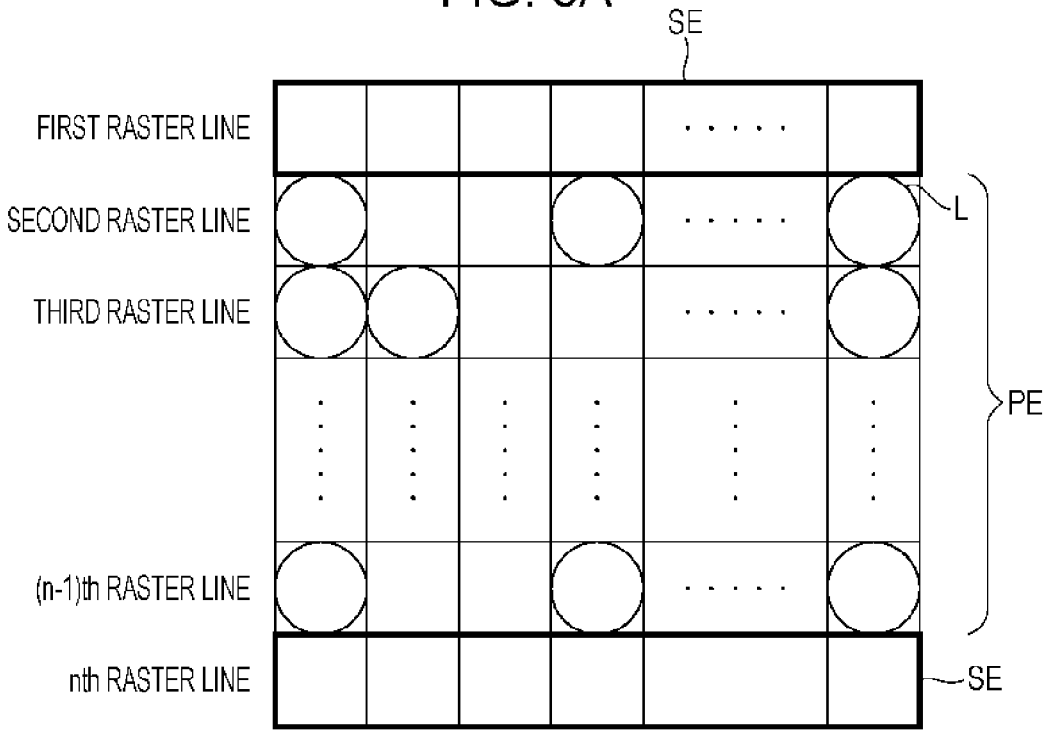
FIG. 8A is a view illustrating a second pattern of an ejecting operation of an auxiliary liquid and an imaging liquid.
Figure 8B:
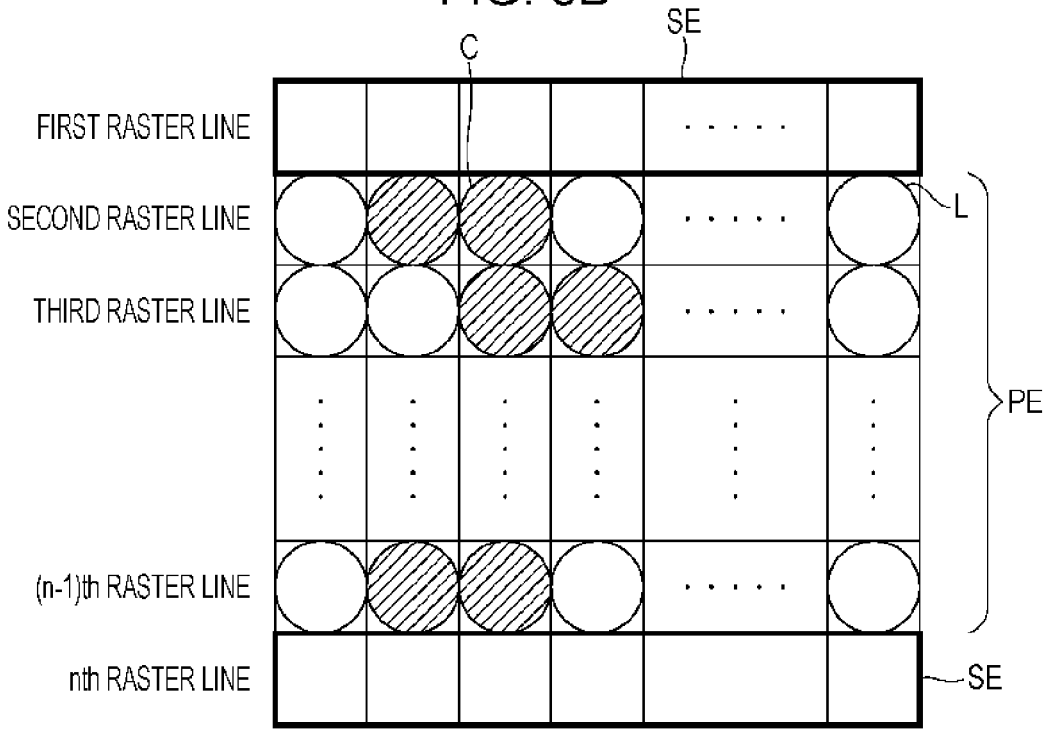
FIG. 8B is a view illustrating the second pattern of the ejecting operation of the auxiliary liquid and the imaging liquid.
Figure 9A:
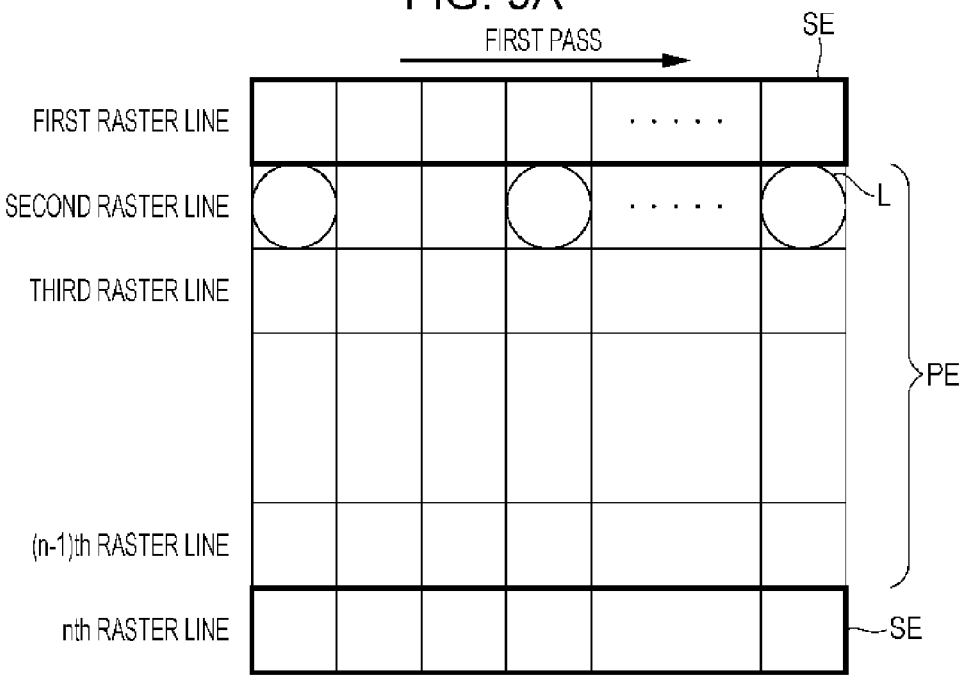
FIG. 9A is a view illustrating another example of the second pattern of the ejecting operation of the auxiliary liquid and the imaging liquid.
Figure 9B:
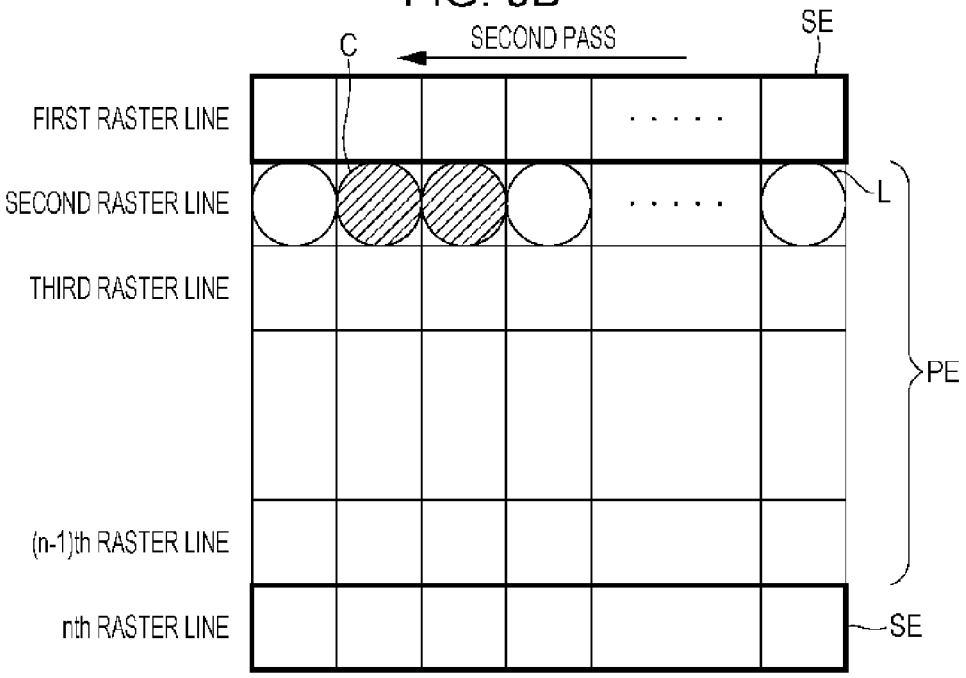
FIG. 9B is a view illustrating another example of the second pattern of the ejecting operation of the auxiliary liquid and the imaging liquid.
Figure 9C:
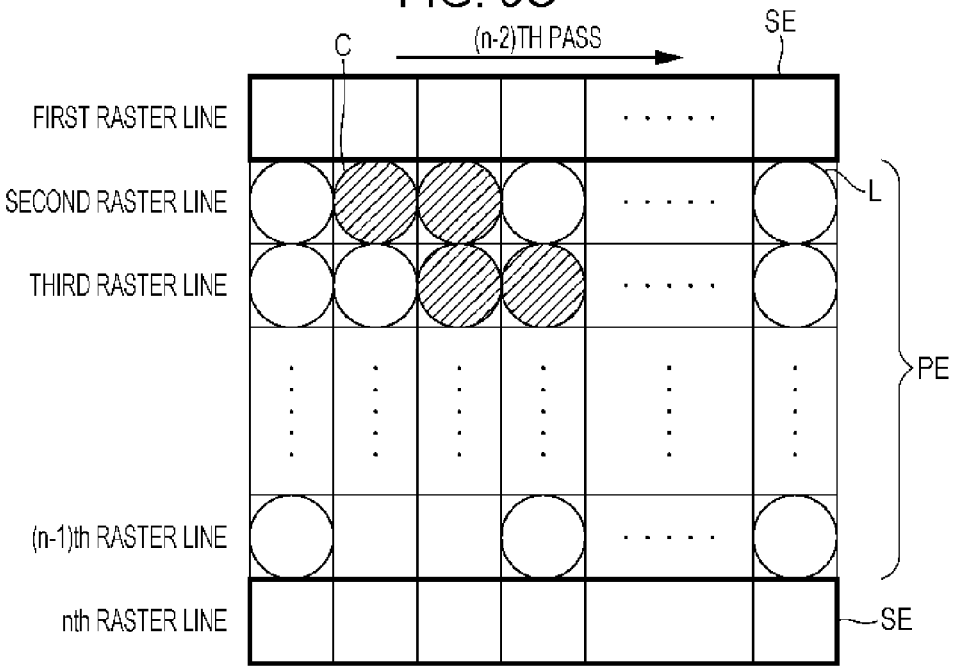
FIG. 9C is a view illustrating another example of the second pattern of the ejecting operation of the auxiliary liquid and the imaging liquid.
Figure 9D:
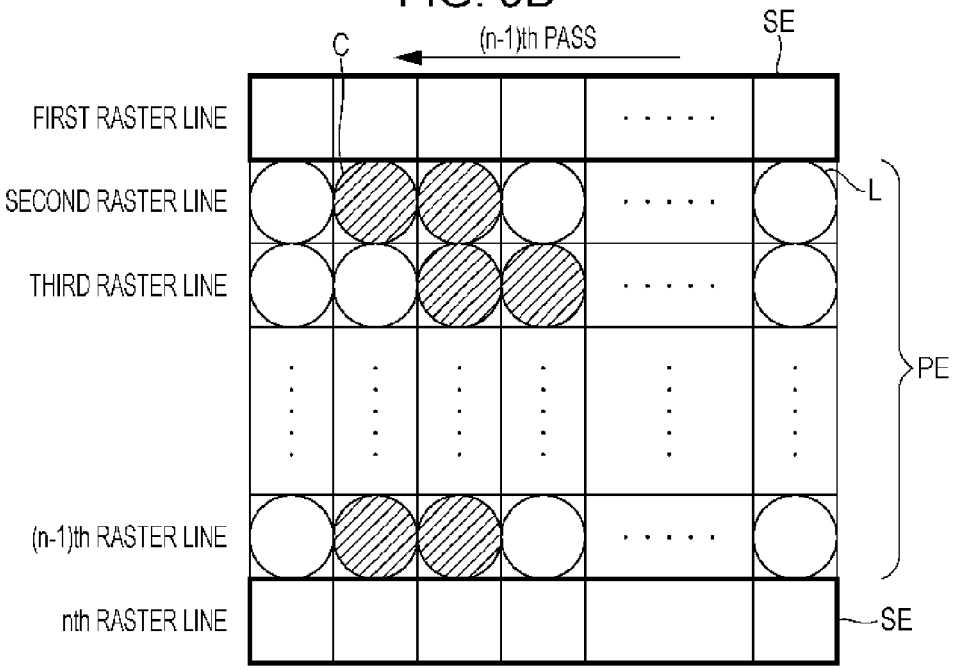
FIG. 9D is a view illustrating another example of the second pattern of the ejecting operation of the auxiliary liquid and the imaging liquid.
Figure 10A:
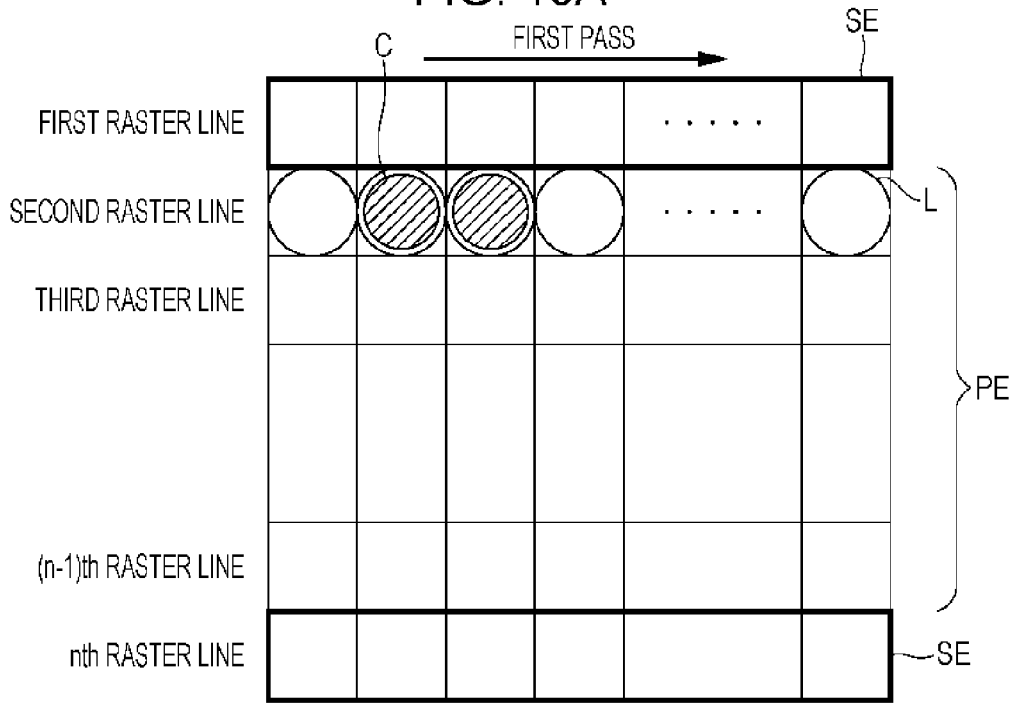
FIG. 10A is a view illustrating a third pattern of an ejecting operation of an auxiliary liquid and an imaging liquid.
Figure 10B:
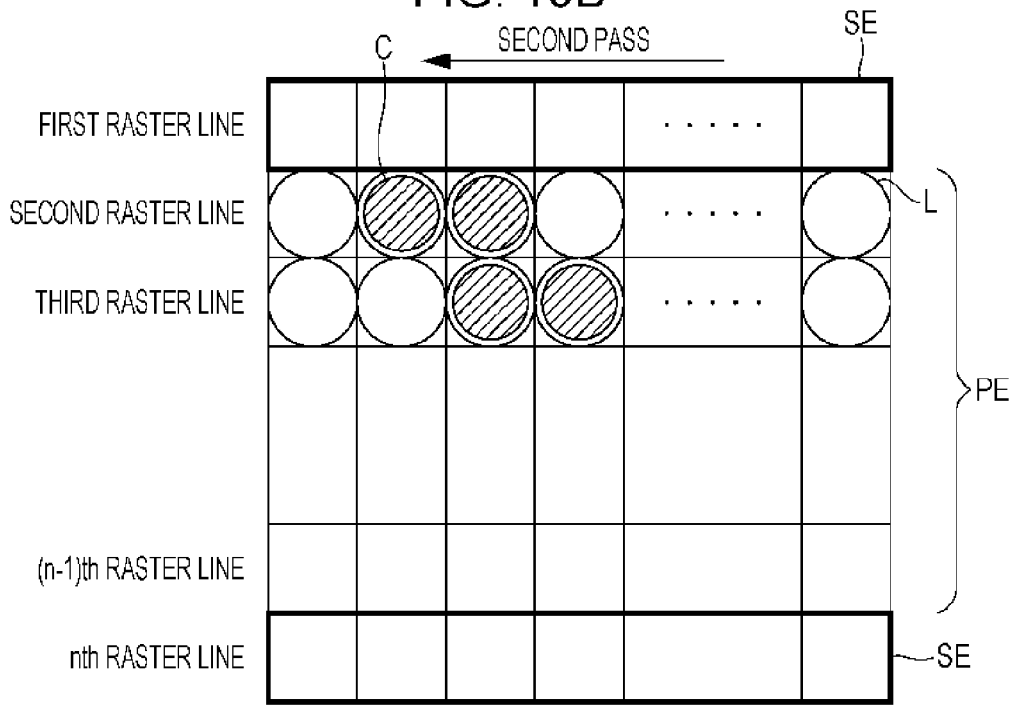
FIG. 10B is a view illustrating the third pattern of the ejecting operation of the auxiliary liquid and the imaging liquid.
Figure 10C:
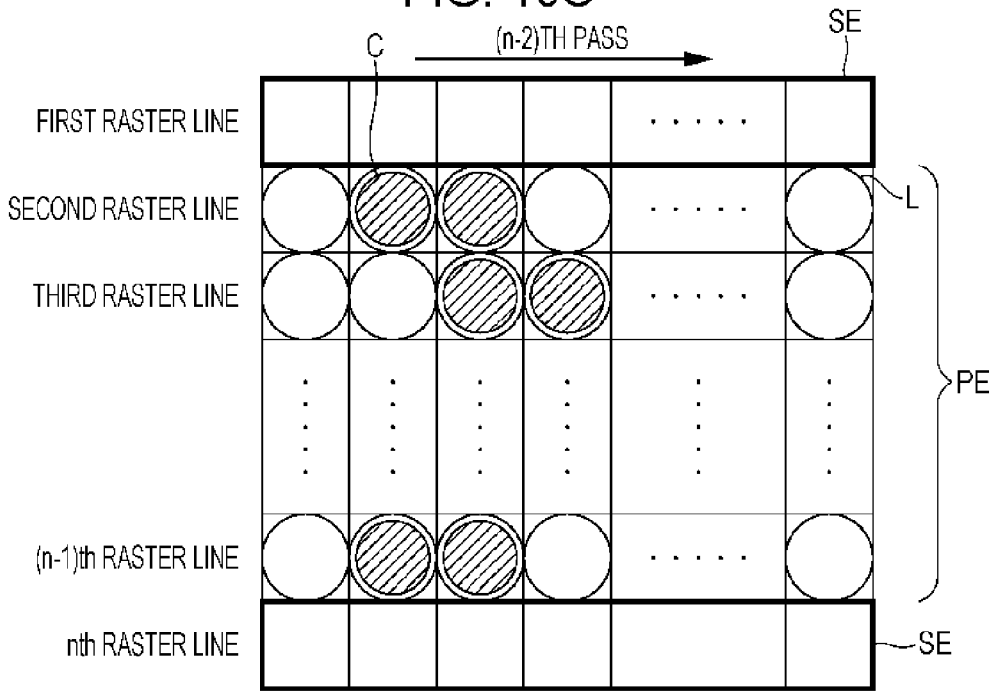
FIG. 10C is a view illustrating the third pattern of the ejecting operation of the auxiliary liquid and the imaging liquid.
Figure 11A:
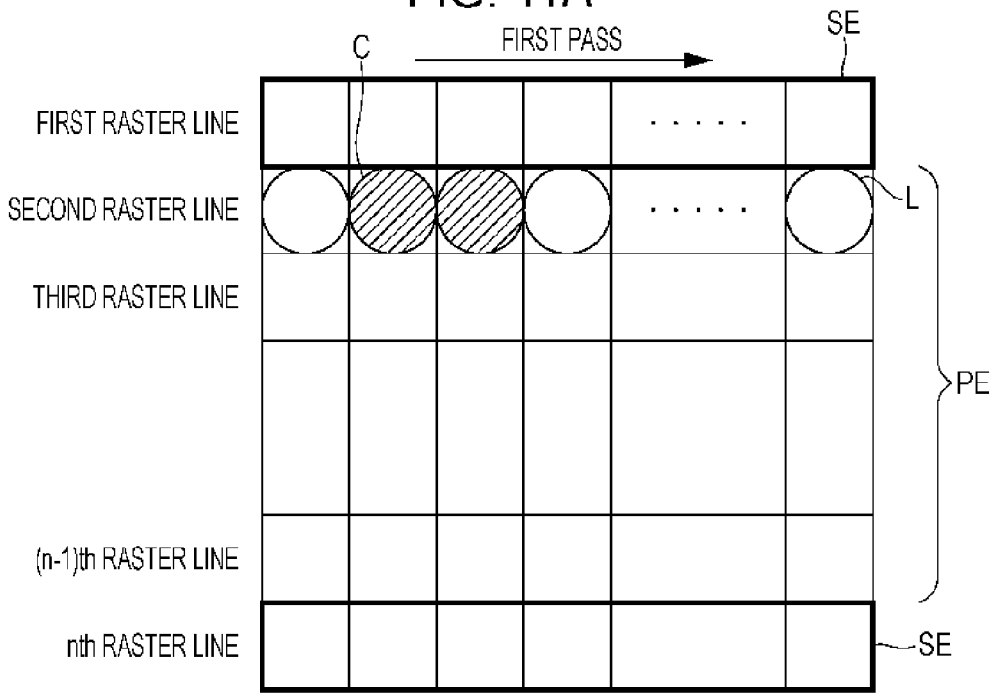
FIG. 11A is a view illustrating a fourth pattern of an ejecting operation of an auxiliary liquid and an imaging liquid.
Figure 11B:
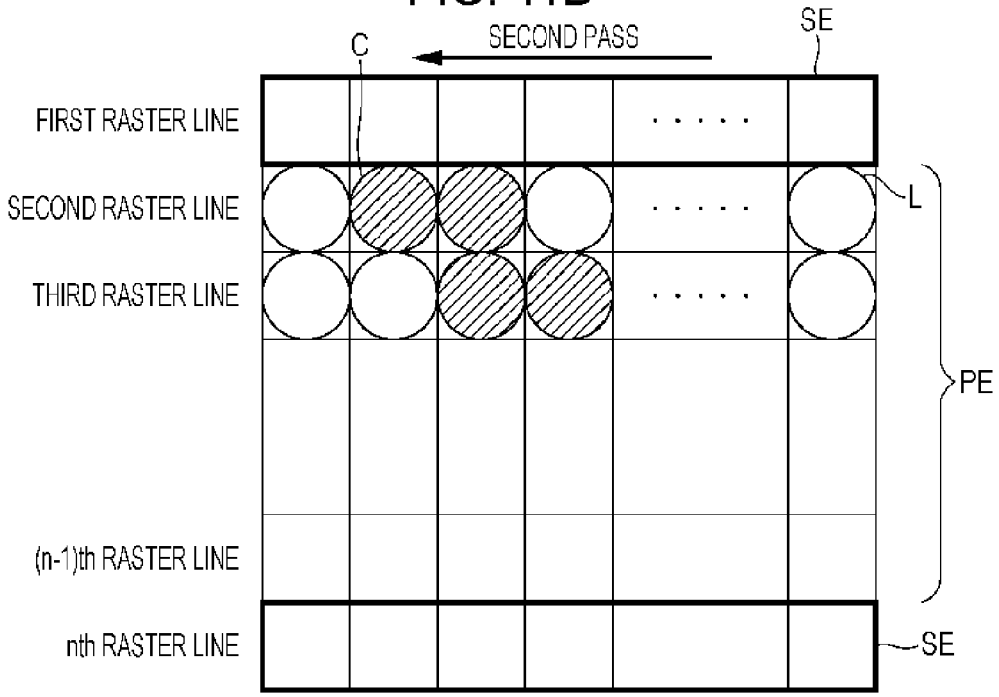
FIG. 11B is a view illustrating the fourth pattern of the ejecting operation of the auxiliary liquid and the imaging liquid.
Figure 11C:
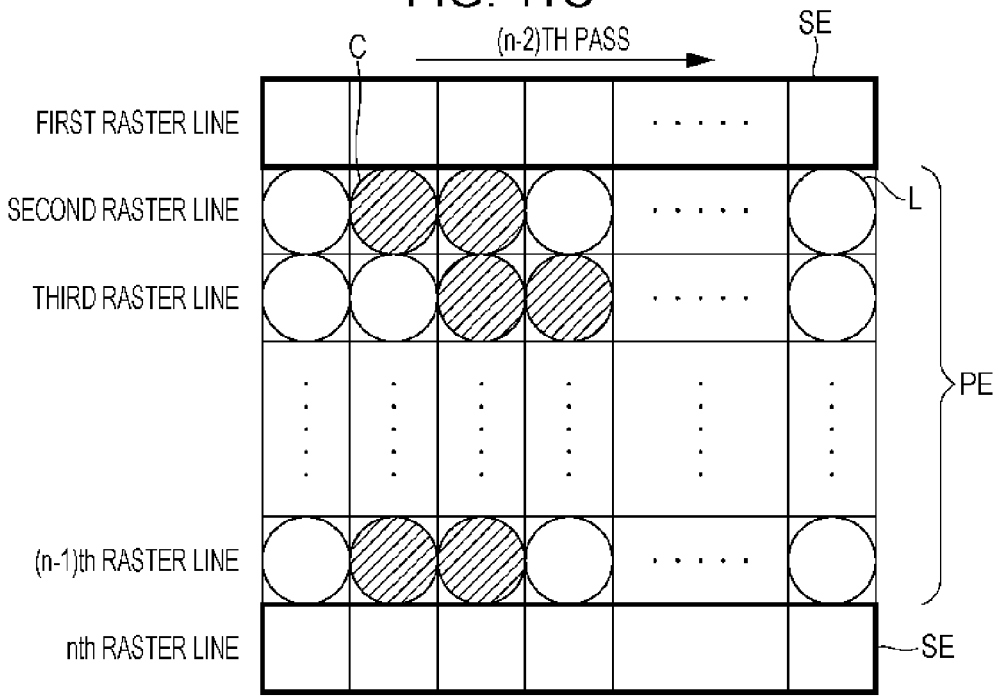
FIG. 11C is a view illustrating the fourth pattern of the ejecting operation of the auxiliary liquid and the imaging liquid.

For example, the head 21 moves two-dimensionally from the initial position (for example, the upper left of the printing medium illustrated in FIG. 8A) with respect to the printing medium and ejects the auxiliary liquid L with respect to the region in which the image is not formed. The head 21 does not eject the auxiliary liquid L in the peeling region SE (the first raster line and the nth raster line), which is set in advance. In this case, the dots of the auxiliary liquid L are formed with respect to the region in which the image is not formed on the printing medium in the printing position except the peeling region SE (see FIG. 8A). In other words, the auxiliary liquid is deposited in the portions of the printing region PE that does not receive the imaging liquid C based on the print data.

Next, the head 21 moves two-dimensionally again from the initial position with respect to the printing medium and ejects the imaging liquid C with respect to the region in which the image is formed. In this case, the dots of the imaging liquid C are formed with respect to the region in which image is formed (see FIG. 8B).

As described above, it is possible to efficiently form the layer of the auxiliary liquid L on the printing medium by ejecting the auxiliary liquid L only in the region in which the image is not formed. Further, it is possible to make the charging amount of the surface of the printing medium be uniform to some extent, by ejecting the auxiliary liquid L to form a layer on the printing medium before the imaging liquid C is ejected. Therefore, it is possible to reduce the influence of the satellites.

Moreover, there is another method for the second pattern. For example, the head 21 ejects the auxiliary liquid L in the region which corresponds to the second raster line and in which the image is not formed in the first pass (see FIG. 9A). In this case, the layer of the auxiliary liquid L is formed in the region in which the image is not formed in the second raster line. Next, the head 21 ejects the imaging liquid C with respect to the region which corresponds to the second raster line and in which the image is formed in the second pass (see FIG. 9B). Similarly, the head 21 ejects the auxiliary liquid L in the region which corresponds to the (n−1)th raster line and in which the image is not formed in the (n−2)th pass (see FIG. 9C) and ejects the imaging liquid C with respect to the region which corresponds to the (n−1)th raster line and in which the image is formed in the (n−1)th pass (see FIG. 9D). In one example, the head 21 does not eject the auxiliary liquid L in the peeling region SE (the first raster line and the nth raster line) which peeling region is set in advance.

Third Pattern

In the third pattern, the controller 60 executes the ejection of the imaging liquid C and the ejection of the auxiliary liquid L with respect to the printing region PE in the same pass. In the third pattern, the controller 60 controls the head 21 so that the ejection of the auxiliary liquid L is executed with respect to the region in the printing region PE which includes the region in which the imaging liquid C is ejected. Further, the controller 60 does not eject the auxiliary liquid L with respect to the peeling region SE.

According to the method, similar to the first pattern, the layer of the auxiliary liquid L is formed in the printing region PE and the image is formed thereon.

First, the head 21 ejects the auxiliary liquid L in the region corresponding to the second raster line in the first pass. At this time, the head 21 ejects the imaging liquid C with respect to the region which corresponds to the second raster line and in which the image is formed in the same pass (the first pass) (see FIG. 10A). That is, when the first pass is complete, the imaging liquid C is ejected on the layer of the auxiliary liquid L on the second raster line.

Next, the head 21 ejects the auxiliary liquid L in the region corresponding to the third raster line in the second pass. At this time, the head 21 ejects the imaging liquid C with respect to the region which corresponds to the third raster line and in which the image is formed in the same pass (the second pass) (see FIG. 10B). That is, when the second pass is complete, the imaging liquid C is ejected on the layer of the auxiliary liquid L on the third raster line.

Similarly, the head 21 ejects the auxiliary liquid L in the region corresponding to the (n−1)th raster line in the (n−2)th pass. At this time, the head 21 ejects the imaging liquid C with respect to the region which corresponds to the (n−1)th raster line and in which the image is formed in the same pass (the (n−2)th pass) (see FIG. 10C). That is, when the (n−2)th pass is complete, the imaging liquid C is ejected on the layer of the auxiliary liquid L on the (n−1)th raster line.

In one example, the head 21 does not eject the auxiliary liquid L in the peeling region SE (the first raster line and the nth raster line) which is set in advance.

As described above, it is possible to efficiently produce the printed matter by ejecting the imaging liquid C and the auxiliary liquid L in the same pass. Further, it is possible to make the charging amount of the surface of the printing medium be uniform by forming the layer of the auxiliary liquid L in the region of the printing medium which includes the region in which the image is formed. Therefore, it is possible to reduce the influence of the satellites.

Fourth Pattern

In the fourth pattern, the controller 60 executes the ejection of the imaging liquid C and the ejection of the auxiliary liquid L with respect to the printing region PE in the same pass. In the fourth pattern, the controller 60 controls the head 21 so that the ejection of the auxiliary liquid L is executed with respect to the region in the printing region PE, in which the imaging liquid C is not ejected. Further, the controller 60 does not eject the auxiliary liquid L with respect to the peeling region SE.

According to the method, similar to the second pattern, the layer of the auxiliary liquid L is formed only with respect to the region (the region in which the image is not formed) in the printing region PE in which the imaging liquid C is not ejected.

First, the head 21 ejects the auxiliary liquid L with respect to the region which corresponds to the second raster line and in which the image is not formed in the first pass. At this time, the head 21 ejects the imaging liquid C with respect to the region which corresponds to the second raster line and in which the image is formed in the same pass (the first pass) (see FIG. 11A). That is, when the first pass is complete, the imaging liquid C and the auxiliary liquid L are ejected on the second raster line. However, in contrast to the third pattern, the layer of the auxiliary liquid L is not formed in the region (the region in which the image is formed) in which the imaging liquid C is ejected.

Next, the head 21 ejects the auxiliary liquid L with respect to the region which corresponds to the third raster line and in which the image is not formed in the second pass. At this time or in the same pass, the head 21 ejects the imaging liquid C with respect to the region which corresponds to the third raster line and in which the image is formed in the same pass (the second pass) (see FIG. 11B). That is, when the second pass is complete, the imaging liquid C and the auxiliary liquid L are ejected on the third raster line.

Similarly, the head 21 ejects the auxiliary liquid L with respect to the region which corresponds to the (n−1)th raster line and in which the image is not formed in the (n−2)th pass. At this time, the head 21 ejects the imaging liquid C with respect to the region which corresponds to the (n−1)th raster line and in which the image is formed in the same pass (the (n−2)th pass) (see, FIG. 11C). That is, when the (n−2)th pass is complete, the imaging liquid C and the auxiliary liquid L are ejected on the (n−1)th raster line.

On the other hand, the head 21 does not eject the auxiliary liquid L in the peeling region SE (the first raster line and the nth raster line) which peeling region is set in advance.

As described above, it is possible to efficiently produce the printed matter by ejecting the imaging liquid C and the auxiliary liquid L in the same pass. Further, it is possible to efficiently form the layer of the auxiliary liquid L on the printing medium by ejecting the auxiliary liquid L only in the region in which the image is not formed or only in the portion of the printing region that does not receive the imaging liquid C based on the print data.

Others

Moreover, in FIGS. 7A to 7D and FIGS. 9A to 11C, in order to simplify the description, an example in which the auxiliary liquid L and/or the imaging liquid C is ejected in the region corresponding to one raster line in one pass is described. On the other hand, for example, as illustrated in FIG. 3, if the head 21 having a plurality of nozzles n is used, it is possible to eject simultaneously the auxiliary liquid L and/or the imaging liquid C in the region corresponding to a plurality of raster lines in one pass.

Figure 7A:
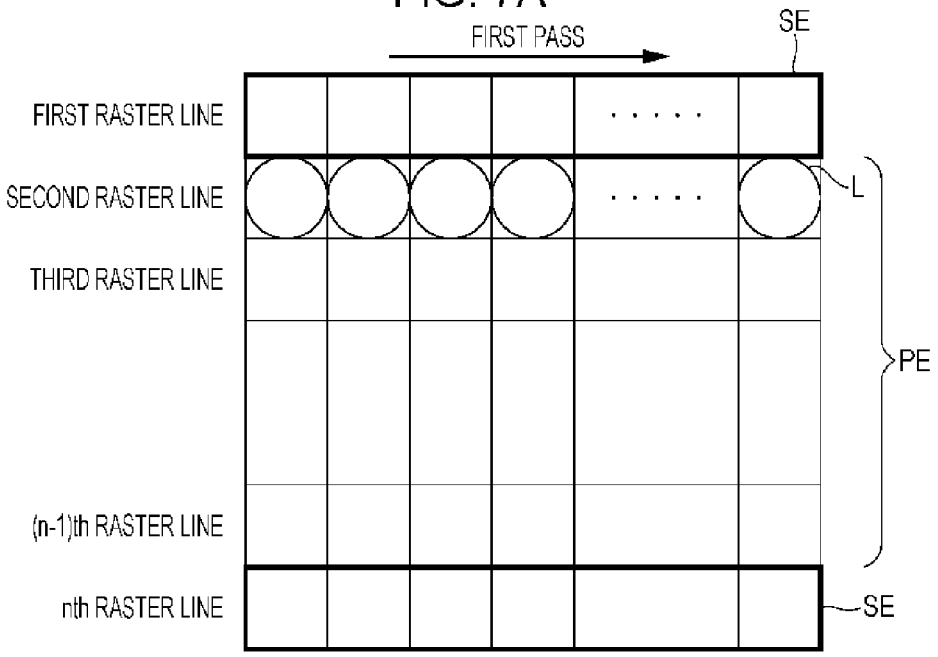
FIG. 7A is a view illustrating another example of the first pattern of the ejecting operation of the auxiliary liquid and the imaging liquid.
Figure 7B:
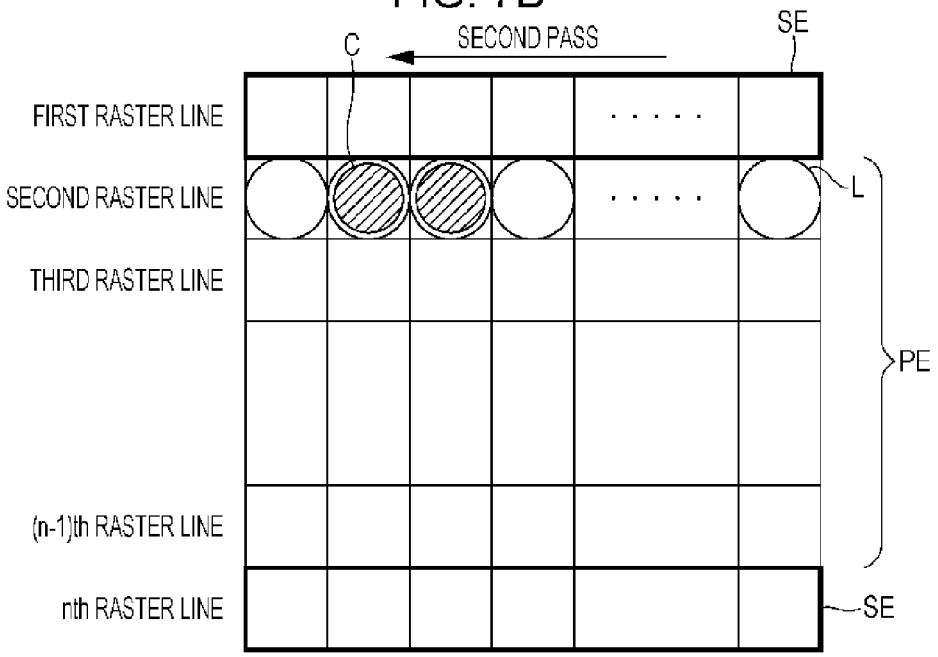
FIG. 7B is a view illustrating another example of the first pattern of the ejecting operation of the auxiliary liquid and the imaging liquid.
Figure 7C:
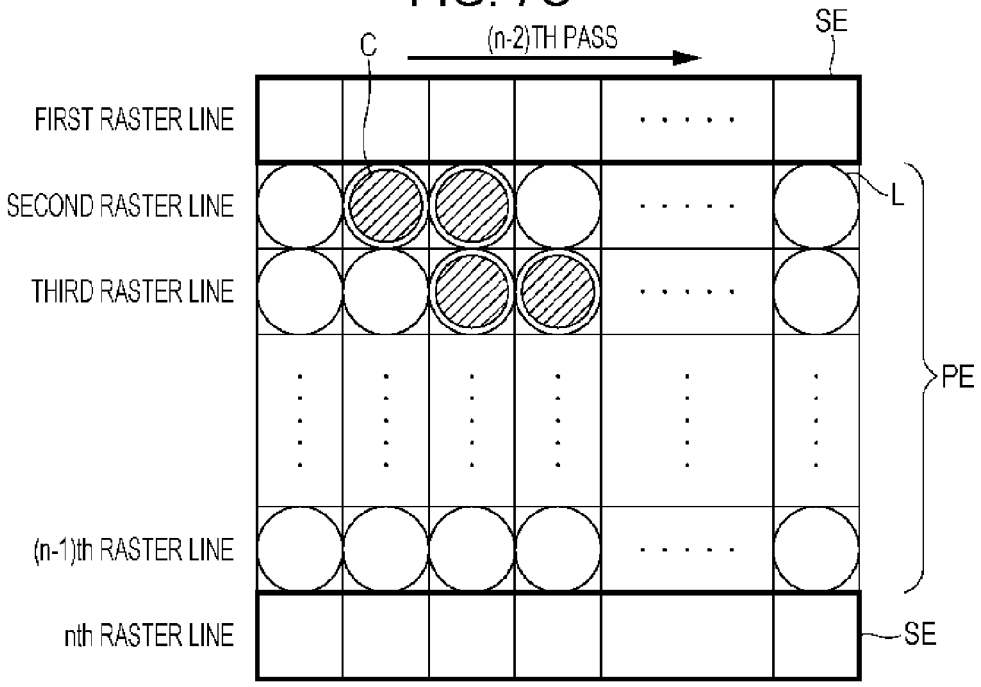
FIG. 7C is a view illustrating another example of the first pattern of the ejecting operation of the auxiliary liquid and the imaging liquid.
Figure 7D:
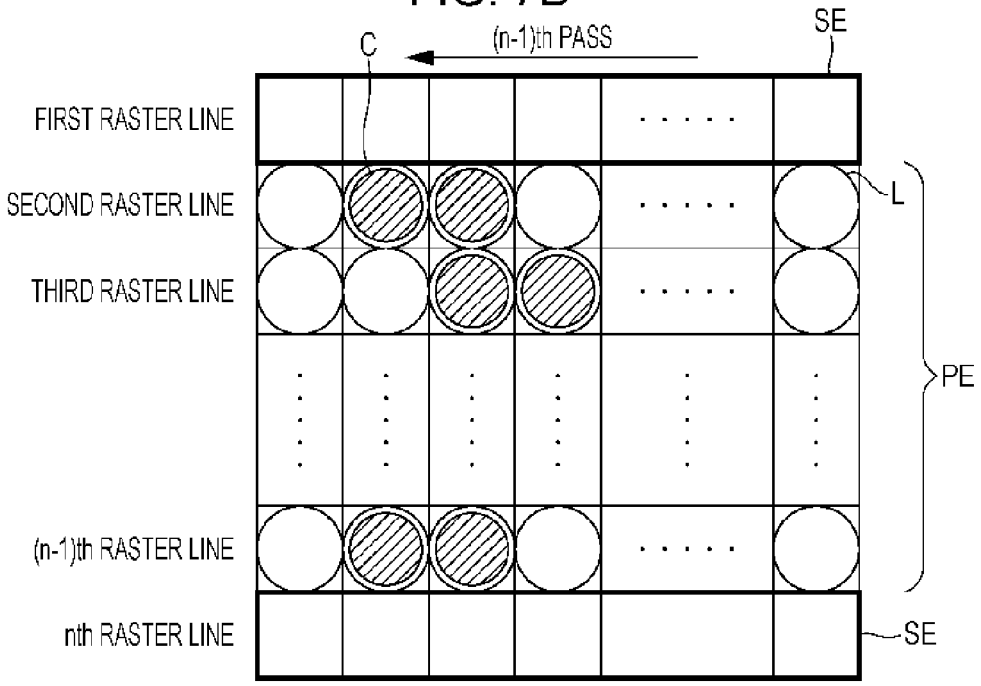
FIG. 7D is a view illustrating another example of the first pattern of the ejecting operation of the auxiliary liquid and the imaging liquid.

Further, in FIGS. 7A to 7D and FIGS. 9A to 11C, an example in which the liquid is ejected in each of reciprocating passes (for example, the first pass and the second pass) is described. However, embodiments of the invention are not limited to the example. For example, it is possible to eject the liquid in only one side pass such as the first pass, the third pass, . . . . In this case, it is possible to secure time for drying the liquid which is ejected. The ejected liquid may dry, for example, while the head 21 returns during the second pass, the fourth pass, . . . . Therefore, for example, as illustrated in FIGS. 7A and 7B, even if the imaging liquid C is ejected in the region in which the auxiliary liquid L is ejected, it is possible to prevent liquids from being mixed together.

Operation of Ink Jet Printer

Figure 12:
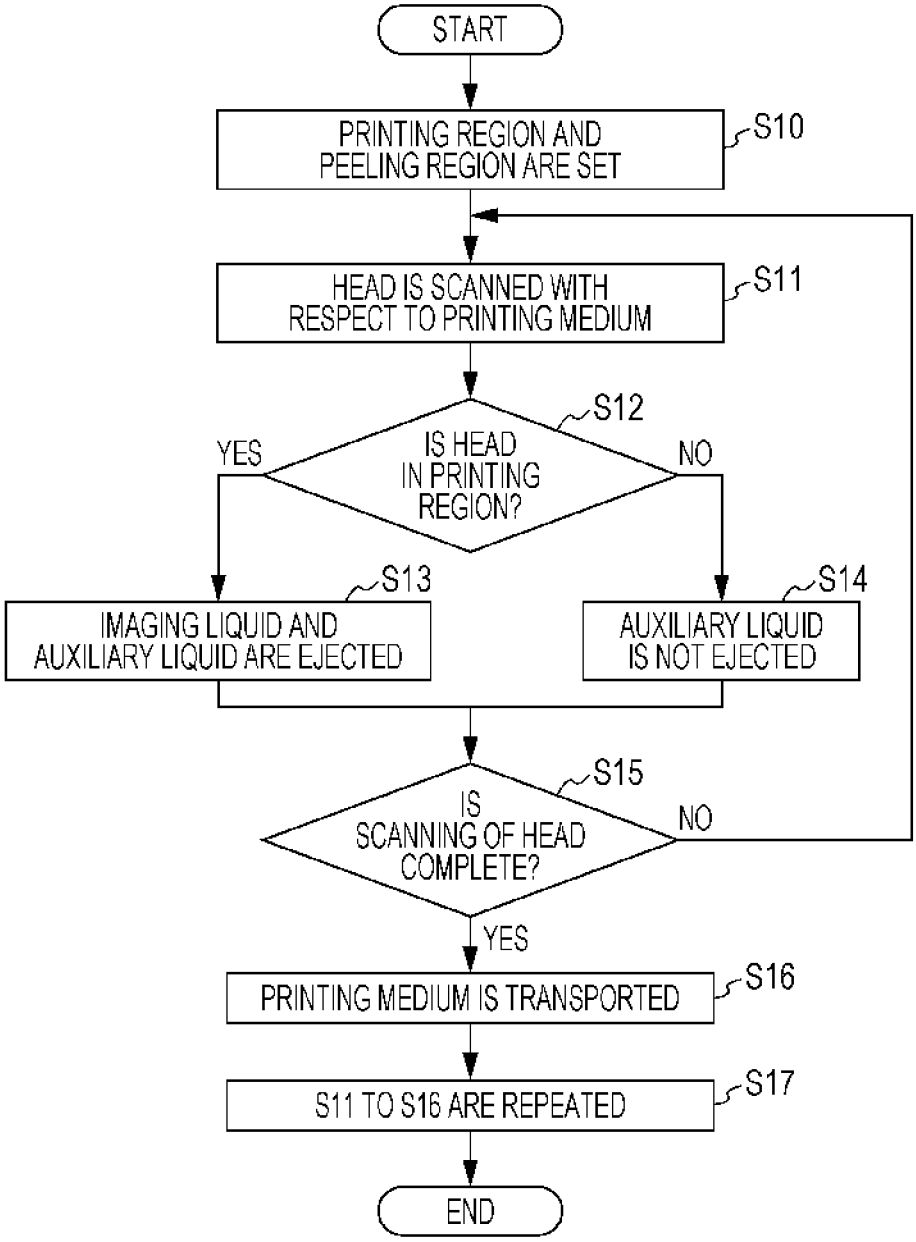
FIG. 12 is a flowchart illustrating an operation of a printing apparatus.

An example of the operation of the ink jet printer 1 is described with reference to FIG. 12.

Before the printing or the printing operation is started, the controller 60 sets the printing region PE and the peeling region SE (S10). After that, the printing is started by the ink jet printer 1, based on the settings in S10. Specifically, the controller 60 causes the head 21 to scan or pass so that the formation of the image is performed with respect to the printing medium in the printing position (S11).

If the head 21 is in the position corresponding to the printing region PE (ifY in S12), the controller 60 controls the head 21 so that the auxiliary liquid L and the imaging liquid C are ejected (S13).

If the head 21 is in the position corresponding to the peeling region SE (if N in S12), the controller 60 controls the head 21 so that the auxiliary liquid L is not ejected (S14).

If the scanning of the head 21 is complete in the printing medium in the printing position (ifY in S15), the controller 60 transports the printing medium and disposes a region in which the image is not formed in the printing position (S16).

The controller 60 repeats the process of S11 to S16 until the desired number of sheets of the image is formed (S17). Therefore, the printing region PE and the peeling region SE are formed in the printing medium on which the image is printed.

In this state, for example, the cutting machine cuts the printing region PE along the cutline CL and peels the peeling region SE. In this case, it is possible to obtain the printed matter (for example, the printed matter on which a plurality of images are printed in a label shape) in which the desired number of sheets of the image is printed.

As described above, the ink jet printer 1 actively provides a portion in which the distribution of the charging amount is not uniform in the printing medium by not forming the layer of the auxiliary liquid L in the peeling region SE. Therefore, the satellites selectively accumulate with respect to the peeling region SE. That is, since a satellite amount accumulated in the printing region PE including the image can be reduced, it is possible to provide the printed matter with less image deterioration. In other words, the satellites are more likely to accumulate in the peeling region SE in part because the auxiliary liquid has not been printed in the peeling region.

Other Embodiments

The embodiments described above are intended to facilitate the understanding of the invention and are not intended to be construed as limiting the invention. The invention may be altered and improved without departing from the spirit of the invention, and it goes without saying that equivalents thereof are included in the invention. In particular, embodiments described below are intended to be included in the invention.

The configuration of the head 21 is not limited to the embodiment illustrated in FIG. 3. The head 21 may have a configuration in which the ejecting operation can be executed in a first mode and a second mode.

The hot platen 41 and the drying device 42 may dry the liquid (ink) forming the image and the layer of the auxiliary liquid formed on the printing medium. Therefore, for example, it may be configured to apply hot air, infrared rays and electromagnetic waves such as microwaves to the printing medium. Otherwise, if an ultraviolet (UV) curable ink is used, a configuration for radiating ultraviolet rays with respect to the printing medium can be also used as the hot platen 41 and the drying device 42.

Further, if the cutting machine cuts the printing region PE along the cutline CL, a cutting position may be shifted due to influence of accuracy of the cutting machine (e.g., the cutting machine does not cut along the cutline CL). For example, if the cutting is performed outside of the cutline CL, a part of the peeling region SE remains with the printing region PE in the printed matter. That is, the surface quality of the printed matter may be difference because the printing region PE and some of the peeling region SE exist in the printed matter.

In one example, the controller 60 controls the head 21 so that the ejection of the auxiliary liquid L is executed with respect to the region in the peeling region SE that is adjacent to the boundary (the cutline CL) between the printing region PE and the peeling region SE. Thus, the auxiliary liquid and the imaging liquid may be deposited in a small region of the peeling region that is adjacent the cut line using any of the patterns disclosed herein.

For example, "the adjacent region" may be set in a pixel region. "The pixel region" is a region on the printing medium corresponding to the pixels on the image data. The printing region PE and the peeling region SE are formed of a plurality of pixel regions. Therefore, the controller 60 controls the head 21 so that the ejection of the auxiliary liquid L is executed with respect to the pixel region in the pixel regions configuring the peeling region SE which is adjacent to the cutline CL.

As described above, even if the cutting position is shifted, it is possible to reduce a possibility the surface qualities on the printed matter are different from each other exist by ejecting the auxiliary liquid L with respect to the region adjacent to the cutline CL. Further, it is possible to accumulate the satellites in the pixel region (the peeling region SE) separated from or outside of the printing region PE by ejecting the auxiliary liquid L to a part or pixel region that is outside of the cutline CL. Therefore, it is possible to reliably reduce the influence of the satellites in the printing region PE.

Further, for example, if the humidity is low during the winter season or the like, there is a possibility that the charging amount is unlikely to be uniform with an ejection amount of the auxiliary liquid that has been set in advance. Embodiments of the invention provide a plurality of modes in which the ejection amounts of the auxiliary liquid are different from each other.

For example, a first mode in which a predetermined amount of the auxiliary liquid is ejected, and a second mode in which the ejection amount of the auxiliary liquid is greater than that of the first mode are provided. The modes are stored in the memory 63 or the like. Selection of the modes can be performed automatically or manually.

In the case of automatically selecting a mode, for example, the controller 60 compares a value (%) of the humidity which is determined by the measuring unit 70 with conditions (for example, the first mode: 30% or more and the second mode: 29% or less) which are set in advance. For example, if the humidity which is measured is 10%, the controller 60 selects and executes the second mode.

On the other hand, in the case of manually selecting a mode, for example, the operator of the ink jet printer 1 confirms a value indicated in a hygrometer in the room. If the value indicated in the hygrometer is low (for example, the humidity of 10%), the operator can determine that the surface of the medium is likely to be charged or that charging of the surface may occur in the printing medium. In this case, the operator selects the second mode which is set in advance through an input section of the ink jet printer 1 or the like. The controller 60 executes the second mode that is selected. Moreover, the ejecting operation of the liquid in the first mode and the second mode is the same as that of the embodiments described above. That is, even if the ejection amount of the auxiliary liquid increases, the auxiliary liquid is not ejected in the peeling region SE.

Further, embodiments of the invention contemplate changing (e.g., increasing) the ejection amount of the auxiliary liquid instead of providing a specific mode. In this case, for example, the controller 60 compares a measured result of the measuring unit 70 with a predetermined threshold. The predetermined threshold is a value (for example, a value based on the humidity such as the humidity of 19% or less) for determining whether or not the amount of the auxiliary liquid which is ejected is increased.

If the humidity measured by the measuring unit 70 is equal to the predetermined threshold or less, the controller 60 controls the head 21 so that the ejection amount of the auxiliary liquid is increased. An increased amount of the auxiliary liquid is set in advance in a predetermined value. Moreover, the ejecting operation of the liquid is the same as that of the embodiments described above. That is, even if the ejection amount of the auxiliary liquid is increased, the auxiliary liquid is not ejected in the peeling region SE.

If the first mode or the second mode is selected, it is possible to consider conditions other than the humidity. For example, as described above, if the peeling region SE is provided, the influence of the satellites may not be considered. Further, the influence of the satellites may not be considered depending on types of the images to be printed or required image quality. Otherwise, since the clear ink is expensive compared to the color ink, if the cost of the entire printing is considered, there may be a case where an amount of the clear ink used is decreased. In this case, for example, the operator sets the first mode through the input section of the ink jet printer 1. The controller 60 executes the first mode which is set regardless of the conditions such as the humidity.

Further, the imaging liquid or the auxiliary liquid may be water-based ink or oil-based ink.

Further, the liquid is not intended to be limited to the ink. A liquid (including a liquid-like body in which particles of a functional material are dispersed and a fluid-like body such as gel, other than a liquid) other than the ink, or a fluid (including a solid body which can be ejected by flowing as a fluid) other than the liquid may be used.

The configuration of the embodiments described above may be also applied to a line printer or an ink jet printer of a serial scan system. The serial scan system is a system in which the image is formed by repeating the ejection of the liquid and the transportation of the printing medium. That is, if the formation of the image is performed in the serial system, when the printing medium is transported, the image is not yet complete, based on the image data. As the ink jet printer of the serial scan system, for example, there is a Large Format Printer (LFP).

The entire disclosure of Japanese Patent Application No. 2013-065799, filed Mar. 27, 2013 is expressly incorporated by reference herein.

What is claimed is:

1. A printing apparatus comprising:

a head that ejects an imaging liquid for forming an image and that ejects an auxiliary liquid for assisting formation of the image by the imaging liquid with respect to a printing medium; and a control section that controls the head so that the imaging liquid and the auxiliary liquid are ejected with respect to the printing medium, wherein if there is a first region in which the imaging liquid and the auxiliary liquid are ejected, and a second region which is peeled after the image is formed in the first region in a region of the printing medium, the control section controls the head so that ejection of the auxiliary liquid and the imaging liquid is not executed with respect to the second region, wherein the second region is peeled such that the first region including the image is removed from the second region.

2. The printing apparatus according to claim 1, wherein the control section controls the head so that the ejection of the auxiliary liquid is executed with respect to a region in the second region which is adjacent to a boundary between the first region and the second region.

3. The printing apparatus according to claim 1, wherein the control section is capable of selectively executing a plurality of modes in which ejection amounts of the auxiliary liquid are different from each other.

4. The printing apparatus according to claim 1, further comprising:

a measuring section that measures a humidity of the printing medium, wherein if a measured result of the measuring section is equal to a predetermined threshold or less, the control section controls the head so that an ejection amount of the auxiliary liquid is increased.

5. The printing apparatus according claim 1, wherein the control section controls the head so that the ejection of the imaging liquid and the ejection of the auxiliary liquid are executed with respect to the first region in different passes.

6. The printing apparatus according to claim 1, wherein the control section controls the head so that the ejection of the imaging liquid and the ejection of the auxiliary liquid are executed with respect to the first region in the same pass.

7. The printing apparatus according to claim 1, wherein the control section controls the head so that the ejection of the auxiliary liquid is executed with respect to a region in the first region which includes the region in which the imaging liquid is ejected.

8. The printing apparatus according to claim 1, wherein the control section controls the head so that the ejection of the auxiliary liquid is executed with respect to a region in the first region in which the imaging liquid is not ejected.

* * * * *